US010633891B2

(12) United States Patent
Sidhu et al.

(10) Patent No.: US 10,633,891 B2
(45) Date of Patent: Apr. 28, 2020

(54) PORTABLE ELECTRONIC LOCK

(71) Applicant: Airbolt Pty Ltd, Templestowe Lower (AU)

(72) Inventors: Kabir Singh Sidhu, Templestowe Lower (AU); Lee Andrew Baker, Preston (AU); Mark Simon Bayly, Eltham (AU); Andrew Robert Fox, Ferntree Gully (AU); Michelle Lisa Rosevear, Moonee Ponds (AU)

(73) Assignee: AIRBOLT PTY LTD., Templestowe Lower, Victoria (AU)

( * ) Notice: Subject to any disclaimer, the term of this patent is extended or adjusted under 35 U.S.C. 154(b) by 0 days.

(21) Appl. No.: 15/752,024

(22) PCT Filed: Aug. 11, 2016

(86) PCT No.: PCT/AU2016/050733
§ 371 (c)(1),
(2) Date: Feb. 12, 2018

(87) PCT Pub. No.: WO2017/024356
PCT Pub. Date: Feb. 16, 2017

(65) Prior Publication Data

US 2018/0230713 A1 Aug. 16, 2018

(30) Foreign Application Priority Data

Aug. 12, 2015 (AU) ..... 2015903230

(51) Int. Cl.
*E05B 49/00* (2006.01)
*E05B 65/52* (2006.01)
(Continued)

(52) U.S. Cl.
CPC ..... *E05B 65/52* (2013.01); *E05B 35/105* (2013.01); *E05B 45/005* (2013.01); *E05B 49/00* (2013.01);
(Continued)

(58) Field of Classification Search
CPC ..... E05B 65/52; E05B 35/105; E05B 49/00; E05B 67/003; E05B 49/004;
(Continued)

(56) References Cited

U.S. PATENT DOCUMENTS 5,598,725 A * 2/1997 Chang ..... B60R 25/0225 340/425.5
5,727,405 A * 3/1998 Cromwell ..... E05B 45/005 340/427
(Continued)

FOREIGN PATENT DOCUMENTS

FR 3011025 A3 3/2015
WO WO-2011/149424 A1 12/2011

OTHER PUBLICATIONS

International Search Report dated Nov. 18, 2016 for PCT Application No. PCT/AU2016/050733.
(Continued)

*Primary Examiner* — Suzanne L Barrett
(74) *Attorney, Agent, or Firm* — Alleman Hall Creasman & Tuttle LLP

(57) ABSTRACT

A portable electronic lock for luggage, comprising: a housing and a securement member in cooperation with the housing to secure an item to the lock; a locking mechanism in the housing in communication with the securement member to releasably secure the securement member to the housing; a communications module in the housing for operating the locking mechanism to release and secure the securement member in response to a wireless signal; and a
(Continued)

secondary release system for releasing the locking mechanism, wherein the secondary release system is selectively operable by a user.

22 Claims, 4 Drawing Sheets

(51) Int. Cl.

| | |
|---|---|
| ***E05B 35/10*** | (2006.01) |
| ***E05B 67/00*** | (2006.01) |
| ***E05B 45/00*** | (2006.01) |
| ***E05B 67/28*** | (2006.01) |
| ***G07C 9/00*** | (2020.01) |
| *E05B 47/00* | (2006.01) |

(52) U.S. Cl.
CPC ..... *E05B 67/003* (2013.01); *E05B 67/28* (2013.01); *G07C 9/00817* (2013.01); *E05B 49/004* (2013.01); *E05B 67/006* (2013.01); *E05B 2047/0084* (2013.01); *E05B 2047/0095* (2013.01); *E05B 2047/0096* (2013.01); *G07C 9/00182* (2013.01); *G07C 9/00309* (2013.01); *G07C 2009/00825* (2013.01); *G07C 2009/00841* (2013.01)

(58) Field of Classification Search
CPC .... E05B 67/006; E05B 17/142; E05B 17/147; E05B 2047/0089; G07C 9/00817; G07C 9/00182; G07C 2009/00825; G07C 2009/00841; G07C 9/00174; G07C 2009/00642
USPC ..... 70/20–38 R, 49, 284, 285, 275–283.1
See application file for complete search history.

(56) References Cited

U.S. PATENT DOCUMENTS 6,046,558 A * 4/2000 Larson ..... G07C 1/32 318/280
6,047,575 A * 4/2000 Larson ..... E05B 47/0012 250/231.14
6,057,779 A * 5/2000 Bates ..... G06Q 50/28 340/10.51
6,761,051 B1 * 7/2004 Tsai ..... E05B 47/0012 70/257
7,236,085 B1 6/2007 Aronson et al.
8,850,858 B2 * 10/2014 Nave ..... E05B 67/22 70/21
9,512,647 B2 * 12/2016 Meersschaert ..... E05B 35/105
D782,279 S * 3/2017 Baker ..... D8/333
9,607,458 B1 * 3/2017 Schleiff ..... G07C 9/00031
2001/0027671 A1 * 10/2001 Davis ..... E05B 17/2092 70/278.3
2006/0117820 A1 * 6/2006 Lanigan ..... B62D 33/0222 70/279.1
2006/0164208 A1 * 7/2006 Schaffzin ..... G07C 9/00182 340/5.64
2006/0283216 A1 12/2006 Marcelle et al.
2006/0288744 A1 * 12/2006 Smith ..... E05B 47/06 70/38 B
2008/0036596 A1 * 2/2008 Auerbach ..... E05B 39/00 340/542
2009/0256676 A1 * 10/2009 Piccirillo ..... E05B 41/00 340/5.65
2009/0282876 A1 11/2009 Zuraski et al.
2010/0083713 A1 * 4/2010 Woodling ..... E05B 47/0603 70/22
2010/0265068 A1 * 10/2010 Brackmann ..... B60P 3/03 340/572.1
2011/0130134 A1 * 6/2011 Van Rysselberghe ..... A47G 29/141 455/422.1
2012/0298119 A1 * 11/2012 Reese ..... E05B 75/00 128/875
2012/0324967 A1 * 12/2012 Goren ..... E05B 47/0012 70/280
2013/0086956 A1 * 4/2013 Nave ..... E05B 67/00 70/20
2014/0002239 A1 * 1/2014 Rayner ..... G08B 13/1427 340/5.61
2014/0208813 A1 7/2014 Reeb
2014/0250954 A1 9/2014 Buzhardt
2015/0020558 A1 * 1/2015 Williams ..... B62H 5/00 70/18
2015/0292244 A1 * 10/2015 Beatty ..... E05B 47/0012 70/20
2016/0036814 A1 * 2/2016 Conrad ..... H04W 12/0023 713/171
2016/0116510 A1 * 4/2016 Kalous ..... G01R 31/392 340/636.1
2017/0103597 A1 * 4/2017 Fisher ..... G07C 9/00309
2017/0103647 A1 * 4/2017 Davis ..... G06F 1/3287
2017/0213406 A1 * 7/2017 Fares ..... G07C 1/10
2017/0243425 A1 * 8/2017 Meganck ..... E05B 47/0615
2018/0165901 A1 * 6/2018 Lai ..... E05B 47/0004
2019/0228601 A1 * 7/2019 Grzenda ..... G07C 9/00817

OTHER PUBLICATIONS

Extended European Search Report dated Mar. 19, 2019 for Application No. 16834322.6.

* cited by examiner

PORTABLE ELECTRONIC LOCK

FIELD OF THE INVENTION

The present invention relates to a portable electronic lock. More particularly, but not exclusively, the invention relates to a portable electronic lock for luggage.

BACKGROUND OF THE INVENTION

It is desirable to lock luggage when travelling, especially during air travel, to prevent unauthorised access to a person's luggage. Not only is theft a concern, but the insertion of restricted or illegal items to be smuggled into another country. Although unauthorised access is highly undesirable, it can be desirable to provide access to other users whom require access to the luggage.

Luggage locks are preferably simple to use and as luggage locks are generally used infrequently they can be hard to find, as can be keys for unlocking. Although combination locks have also been proposed, it can also be difficult to remember the combination.

Also, losing luggage and a lock is a common problem and some previously proposed luggage locks have also been unreliable. Furthermore, it can be desirable to selectively permit access to a luggage lock to other people.

Examples of the invention seek to solve, or at least ameliorate, one or more disadvantages of previous luggage locks and/or to provide a simplified process for locking luggage.

SUMMARY OF THE INVENTION

According to one aspect of the present invention, there is provided a portable electronic lock for luggage, comprising:

- a housing and a securement member in cooperation with the housing to secure an item to the lock;
- a locking mechanism in the housing in communication with the securement member to releasably secure the securement member to the housing;
- a communications module in the housing for operating the locking mechanism to release and secure the securement member in response to a wireless signal; and
- a secondary release system for releasing the locking mechanism, wherein the secondary release system is selectively operable by a user.

According to a preferred embodiment, the secondary release system is operable on insertion of a key into a receptacle in the housing. Preferably, operation of the secondary release system generates an electrical signal for releasing the locking mechanism.

According to another aspect of the present invention, there is provided a portable electronic lock for luggage, comprising:

- a housing and a securement member in cooperation with the housing to secure an item to the lock;
- a locking mechanism in the housing in communication with the securement member to releasably secure the securement member to the housing;
- a communications module in the housing for operating the locking mechanism to release and secure the securement member in response to a wireless signal; and
- at least two buttons on the housing, the buttons operable for manually releasing the locking mechanism on performance of a predetermined unlocking sequence.

In this aspect, the lock further can comprise a secondary release system for releasing the locking mechanism, wherein the secondary release system is selectively operable by a user.

According to preferred embodiments, the securement member is a cable, an end of which is secured within the housing on operation of the locking mechanism. In some embodiments, the housing can include an indentation in which an intermediate portion of the cable can be received when in a secured condition.

Preferably, the locking mechanism includes an electric motor operable to bring a locking pin into engagement with an end of the securement member to secure it within the housing.

Preferably, the communications module is configured for operation using a Bluetooth protocol.

Preferably, the locking mechanism is operable when in close proximity with a paired mobile device and, more preferably, the locking mechanism is operable only when a passcode has been entered into the paired mobile device.

In some embodiments, the location of the lock can be determined through communication with an unpaired mobile device. The lock may further include an alarm operable when the lock moves outside a predetermined boundary.

The lock can further include an indicator for locating the lock. Preferably, the indicator provides an audible or visible indication. Preferably, the housing has slots formed therein, in which ends of zippers can be received to secure the zippers together within the housing.

Preferably, the lock can be configured to be operable in response to wireless signals from more than one device.

BRIEF DESCRIPTION OF THE DRAWINGS

Preferred embodiments of the invention will be further described, by way of non-limiting example only, with reference to the accompanying drawings in which.

DETAILED DESCRIPTION

Figure 1:
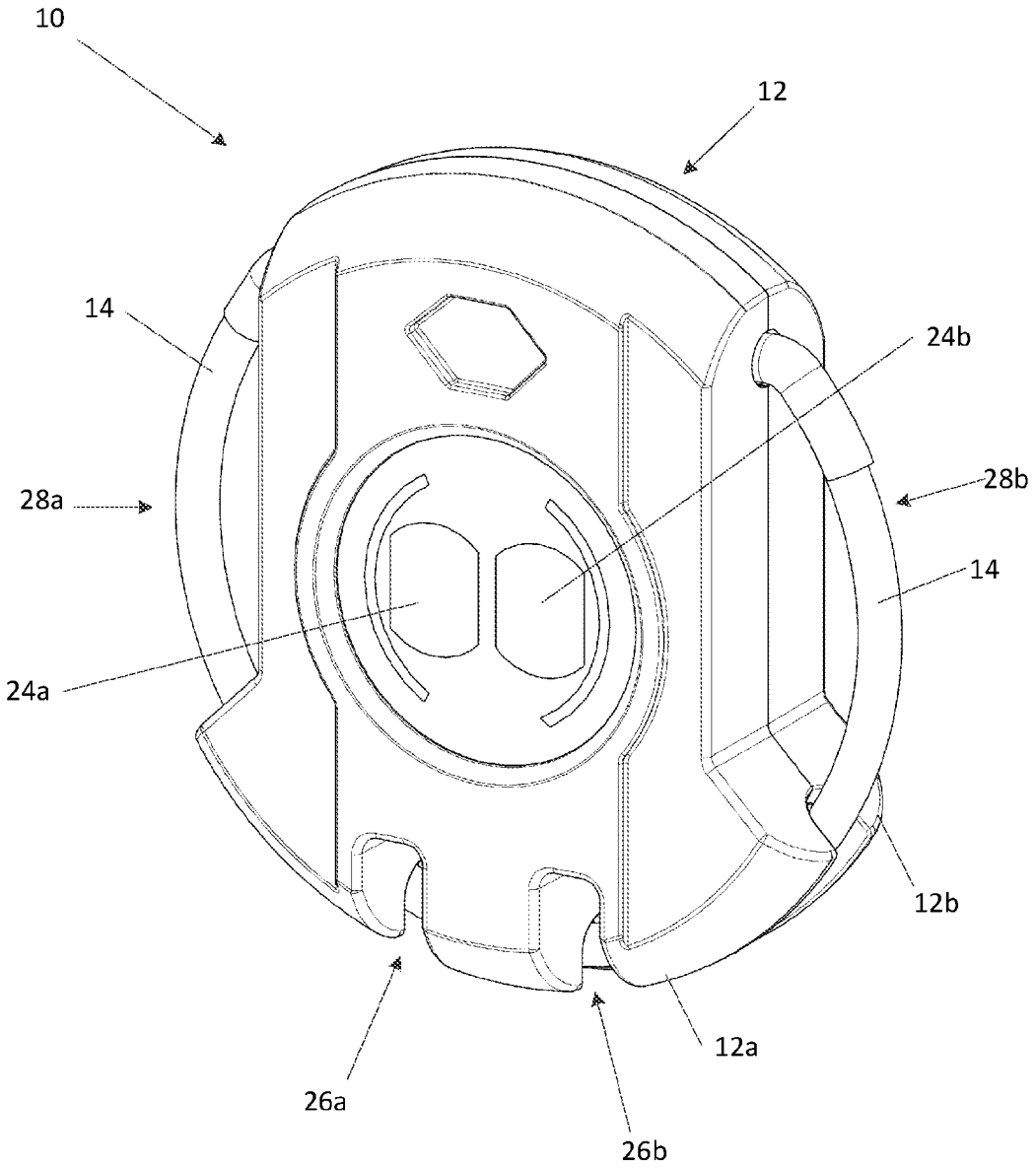
FIG. 1 is a perspective view of a lock of one embodiment of the invention.

FIG. 1 illustrates a portable electronic lock 10 in accordance with a preferred embodiment of the present invention. The lock 10 is configured for use with luggage, in particular, locking ends of zippers together to prevent unauthorised access to a users luggage.

Figure 4:
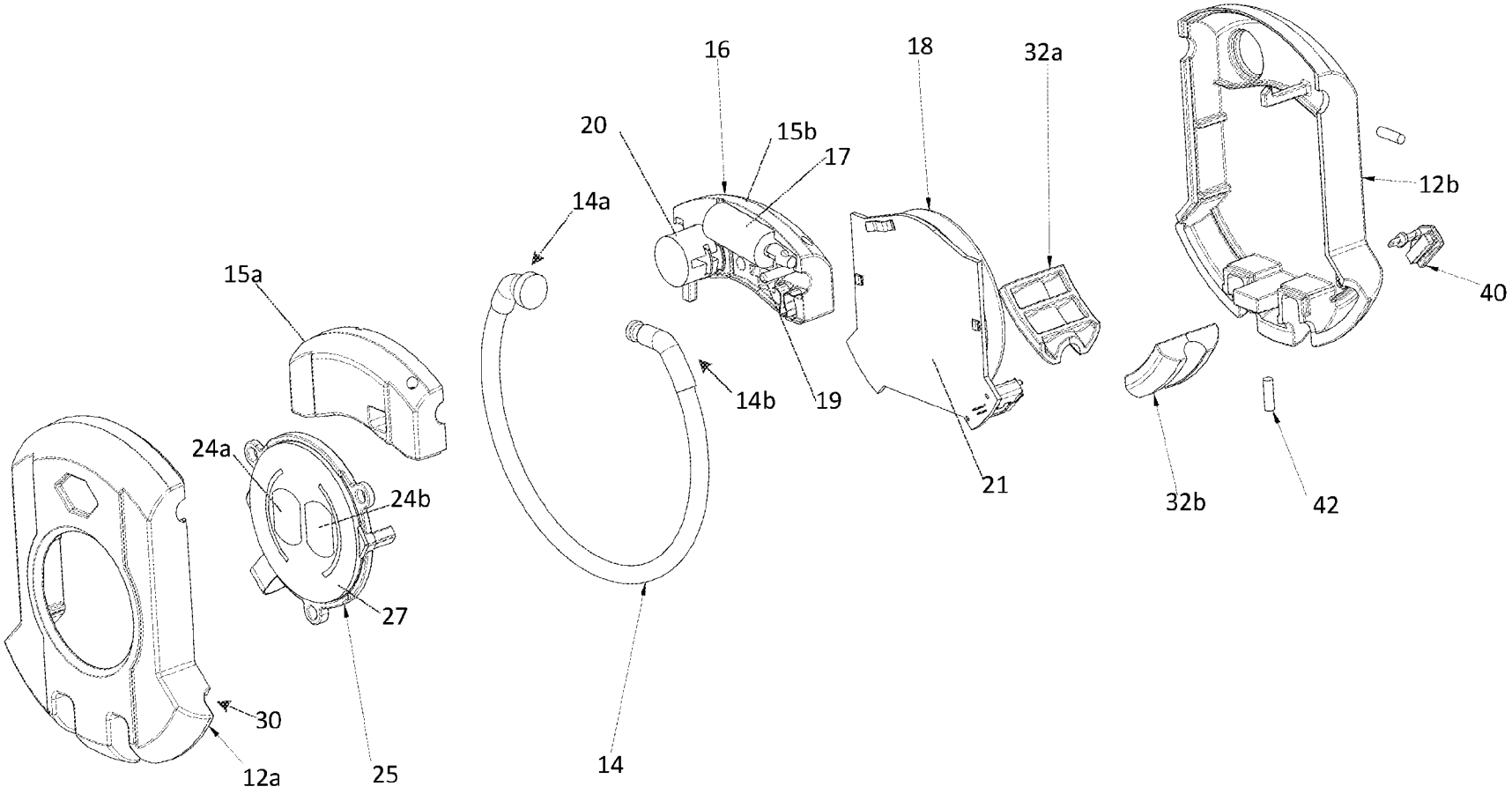
FIG. 4 is an exploded view of the lock.

The lock 10 comprises a housing 12, formed in two parts 12*a*, 12*b* and which is preferably waterproof and shockproof, and a securement member 14 in cooperation with the housing to secure an item to the lock 10. The lock 10 also comprises a locking mechanism 16 in the housing 12 in communication with the securement member 14 to releasably secure the securement member 14 to the housing 12, and a communications module in the housing 12 for remotely operating the locking mechanism 16 (refer FIG. 4) to release and secure the securement member 14.

The locking mechanism 16 may be protected by forward and rear covers 15*a* and 15*b*. To assist with assembly, the lock 10 may include assembly pin 42.

Figure 2:
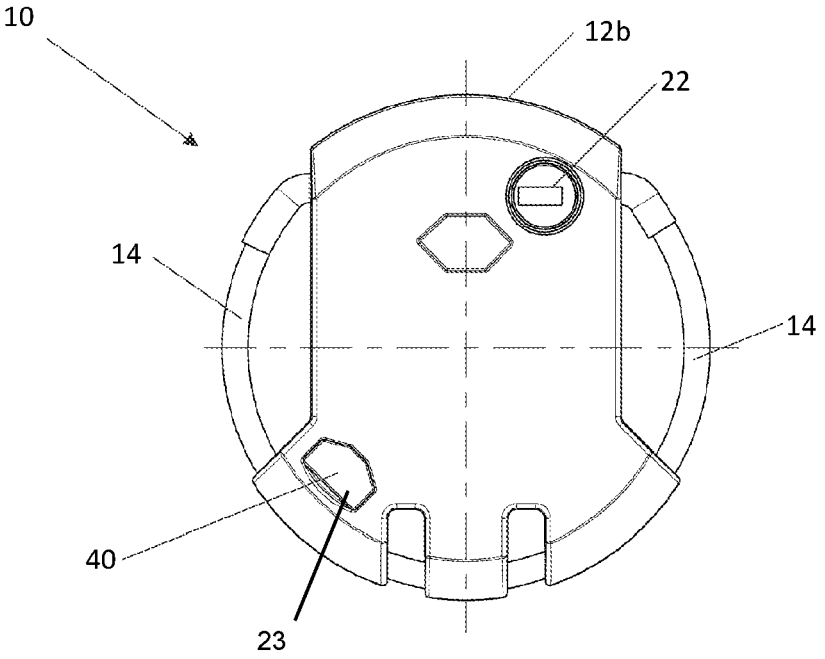
FIG. 2 is a rear view of the lock.

In some embodiments, the lock 10 includes an override system or secondary release system 20 for releasing the locking mechanism 16, wherein the secondary release system 20 is selectively operable by a user. The secondary release system 20 is operable on insertion of a key into a receptacle 22 in a rear portion 12*b* of the housing 12, as illustrated in FIG. 2. In a preferred form, the secondary release system 20 is configured to be operable on insertion of a master key of the United States Transport Security Administration (TSA) to allow use of the lock 10 for travel to/from or within the United States or other countries using similar travel regulations and TSA approved locks. In contrast to earlier proposed locks, operation of the secondary release system 20 by insertion of the key generates an electrical signal for releasing the locking mechanism 16.

So that the secondary release system 20 can be selectively operable by a user, the lock 10 is programmable so that in one mode of operation the secondary release system 20 can be used to release the locking mechanism 16 and in another mode of operation, use of the secondary release system 20 will not release the locking mechanism 16. The secondary release system 20 operates via an electrical contact that is closed on insertion and/or rotation of a TSA master key in the barrel. In one form a displaceable pin is inserted into the barrel and in another form an arm protrudes from the barrel for contacting and closing a contact or operating a micro switch so that insertion of a TSA master key and rotation of the barrel will provide a signal to release the locking mechanism. By configuring the lock 10 in this way, a user can select the desired level of security and whether or not they wish for the TSA to have access to the lock 10. Also, by configuring the lock 10 in this way the lock 10 cannot be opened by using the barrel to pick the lock and gain unauthorised access. It will be appreciated that in addition to a master key, the TSA may be provided on the lock 10 with an electronic master device such a key fob for example.

In some embodiments, the lock includes at least two buttons 24*a*, 24*b* on the housing 12, in particular on a front face 12*a* of the housing. The buttons 24*a*, 24*b* form part of a button assembly 25, which is covered by a membrane seal 27 to prevent water intrusion into the housing 12. The buttons 24*a*, 24*b* are operable for manually releasing the locking mechanism on performance of a predetermined unlocking sequence, which may be pre-programmed by a user. In one example, the predetermined locking sequence includes the order of pressing the buttons, either together or individually, and in other examples the length of time that the buttons are pressed is a feature of the predetermined locking sequence. It will be appreciated that more than two buttons may be provided for a user to input an unlocking sequence and unlock the lock 10. In other embodiments, the lock 10 may be voice activated, using Siri/Amazon to control unlocking.

In the illustrated embodiments, the securement member 14 is a cable, an end 14*b* of which is secured within the housing 12 on operation of the locking mechanism 16. In the illustrated embodiments, the securement member 14 is in the form of a cable or wire rope, though it will be appreciated that other forms of securement member may be used, such as a rigid member. Also, when the securement member 14 is in the form of a cable, the lock may be configured so that the length of the cable can be extended when in an unlocked configuration. In the illustrated embodiments, a first end 14*a* of the cable is secured within the housing 12 by a generally circular plug that allows rotation of the first end 14*a* though not removal. A second end 14*b* of the cable is releasably secured within the housing 12. To achieve this, the locking mechanism 16 includes an electric motor 17 operable to bring a locking pin 19 into engagement with an end 14*b* of the securement member 14 to secure it within the housing 12.

Figure 3:
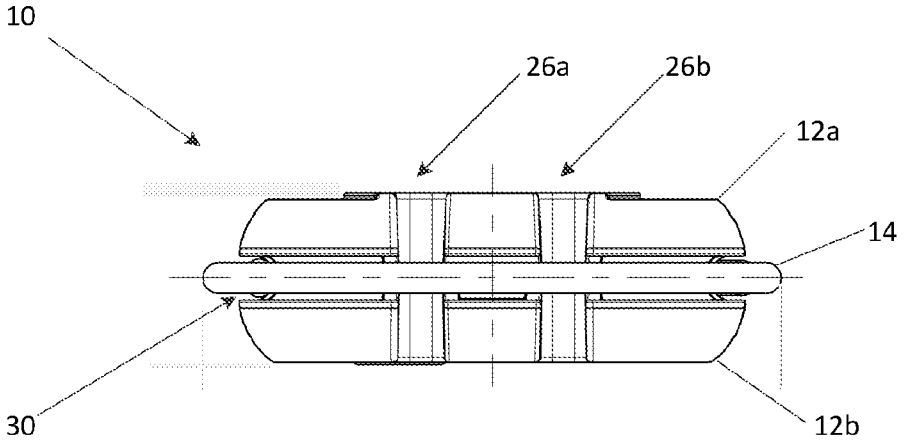
FIG. 3 is a bottom view of the lock.
Figure 5:
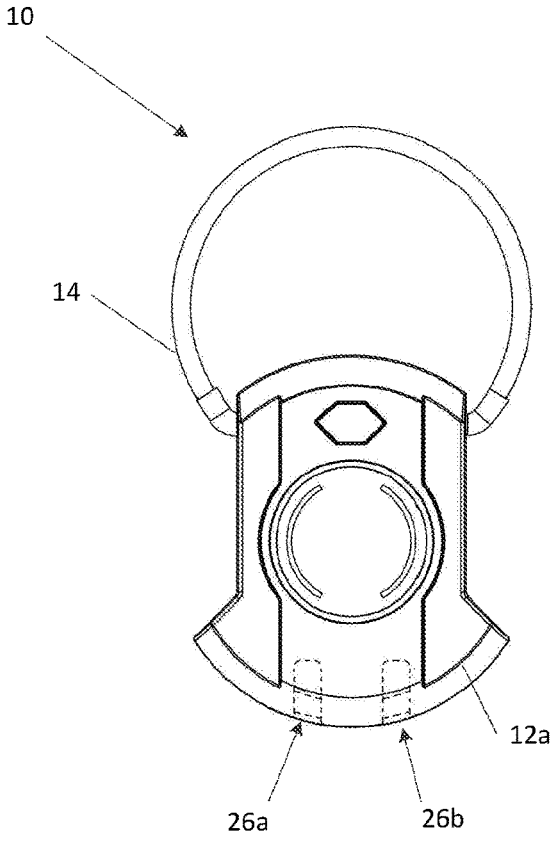
FIG. 5 is a front view of the lock in a second condition of use.
Figure 6:
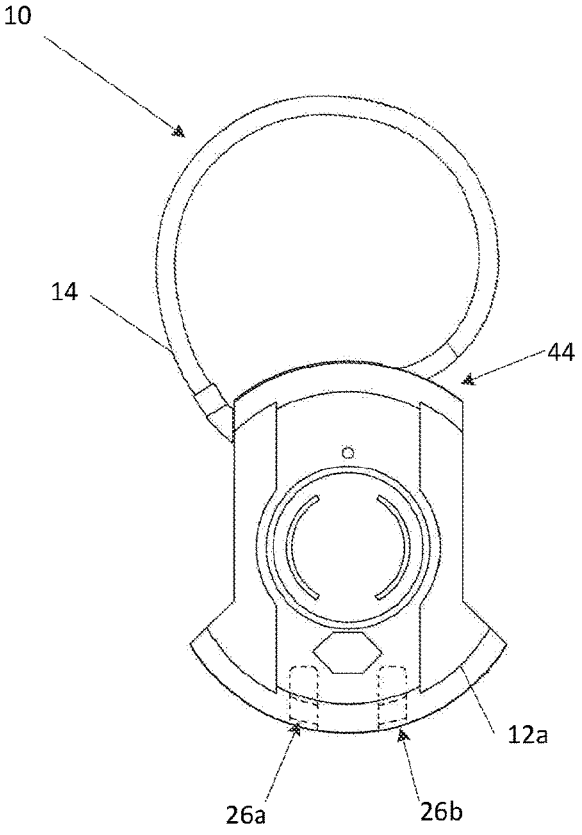
FIG. 6 is a front view of another lock in a second condition of use.

On releasing of end 14*b*, the securement member 14 can be removed from the housing 12 and used to secure the lock to an item or to secure a number of items together. For example, the lock 10 may be used to secure ends of a zippers together to prevent unauthorised access to a travel bag, in which case once released the now free end 14*b* would be passed through apertures in the zipper ends so that once the free end 14*b* has been resecured within the housing, the zippers are secured together. In the illustrated embodiment, the housing 12 has slots 26*a*, 26*b* formed therein, in which ends of the zippers can be received, though it will be appreciated that side portions 28*a*, 28*b* of the securement member 14 may also be used to secure differently sized items such as tags or fabric loops. As can be seen in FIG. 3, the housing 12 includes an indentation 30 in which an intermediate portion of the cable 14 can be received when in a secured condition. In an alternative method of use, the cable 14 may be secured without resting in the indentation 30 so as to secure larger items, such as bicycles or other sporting/leisure equipment. Such conditions of use are shown in FIGS. 5 and 6. In an alternative form of the lock 10, so as to provide additional flexibility and securing, the housing 12 may be formed with a notch 44 in which a recess is formed for receiving the cable.

The communications module is integrally formed within a PCB board 18 and is configured for operation using a Bluetooth protocol, preferably a Bluetooth protocol 4.0 or above, such as Bluetooth 4.2 low energy protocol for example, although it will be appreciated that other wireless communication protocols may also be used. The lock 10 is configured so that the locking mechanism 16 is operable when in close proximity with a paired mobile device. To achieve this, the mobile device is preferably a mobile phone having software installed, which may be in the form of an App, that facilitates the synchronisation between the lock 10 and the mobile device for operation of the lock 10 from the mobile device. To prevent unauthorised use, encryption of communication data may be used. In one form, the lock 10 operates in the following manner, when a user clicks a button on the lock 10, it looks for a security key on the mobile device and, if they match, the lock 10 unlocks.

When a user presses a button, such as the left button for example, the status of the lock is changed, i.e. it broadcasts that "button press=yes". A paired mobile device can detect this status change and, if desired, send a command to unlock. This communication is done securely under encryption. In order for the lock to be unlocked, the paired mobile device needs to send a hashed security key which is checked by the lock and, if correct, the lock unlocks. This provides a very secure system deploying encryption and hashing.

The describer encryption and key operation method may be used for all possible lock commands, such as alerts, lock, unlock, change programmed keys, change button code etc. Changing a programmed key results in a change the security key of the lock, which may be performed using an authorised phone and the old key, hashing code and user details, should this ever be required.

The lock 10 is preferably configured to operate with different levels of security, which may be simply high and low security, though other intermediate levels may also be possible. In this regard, in low security level operation, a user may press a button on the lock 10 and if the paired mobile device can be found then the lock unlocks. In a higher security level operation, a prompt such as a passcode may be required to be entered on the mobile device to allow operation of the lock. Also, touch ID/a fingerprint recognition system may be used to allow operation of the lock.

A software development kit may be provided for user customisation of subsidiary features and functions of the lock 10. It will be appreciated that such software will enable diverse operation functionality and customisation of a user experience.

The following are examples of different operating functions that may be programmed into the lock. It will be appreciated that these features are not mutually exclusive and that various different features may be group and incorporated into different embodiments of the lock. In one form, the locking mechanism 16 is operable only when a passcode has been entered into the paired mobile device. In other forms, the locking mechanism 16 may be operable based on proximity of the paired mobile device to the lock 10. In another form, the lock 10 may be configured for automatic relocking if unlocked via the communications module or buttons 24*a*, 24*b* but the securement member 14 is not removed from the housing 12. Also, the lock 10 may be configured to lock for a predetermined period of time, such as 30 seconds for example, on entering an incorrect security code or an incorrect button combination. Also, communication between the lock 10 and mobile device may be such that a user can check if the lock 10 is locked via the App installed on the mobile device. If a user's luggage is misplaced or stolen, the lock 10 may be programmable via the mobile device so as to be inoperable or only operable on entering a master code particular to the lock 10 and programmed during manufacture. The App may also be configured to allow a user to log into an unpaired device and communicate with their lock provided that certain security measures are satisfied, such as for example, identification of the lock and entering a correct password.

By providing a customisable module to the development community, users may be able to gamify their experience and use the lock for leisure activities such as treasure hunts or scavenger hunt type contests.

Location of the lock 10 may be achieved via a GPS system or a crowd sourced GPS/crowd location tracking system. In this regard, the lock 10 may be detectable by devices other than a paired mobile device so that the location of the lock may be determined. To achieve this, the App may be configured so that when the software is installed on different user's mobile devices, locks of others users may be detected so that, using GPS location services on the mobile device and the knowledge that the used wireless protocol has a limited field strength, the approximate location of identified locks can be identified and relayed to a central server so that a user may remotely determine the location of their lock. By using location data from a mobile device, the lock 10 may function as if it is a GPS enabled unit to allow location of the lock 10 from a user's mobile device.

It will be appreciated that for such a system to operate effectively, a number of users are required to have the App installed and active on their mobile devices. To improve the effectiveness of this system, detection modules may be installed at additional locations such as in airports by third party equipment suppliers. Communication may be via Bluetooth or WIFI or via the internet using a IPv6 protocol for example. Also, communication between locks may be possible to boost communication signals or create a mesh network with multiple devices communicating with each other to share information.

To enable positioning of the lock 10, in alternative forms it may alternatively be provided with a GPS module or an asynchronous GPS system which may or may not use a mobile network.

The lock 10 may include audible or visible indicators, in the form of a LED or an audible alarm or buzzer for example, for locating the lock to assist a user trying to locate the lock 10 in their home, office or hotel. The indicators may also be operable when the lock 10 moves outside a predetermined boundary to prevent unauthorised transportation of a users luggage. The PCB 18 may also be configured to record locking and unlocking history, and corresponding GPS locations may also be recorded.

The lock 10 also includes a rechargeable battery 21 fixed to the PCB board 18. The battery 21 is preferably chargeable using a microUSB connector which can be received in port 23 shown in FIG. 2, though other connection forms may also be used, such as USB Type C for example or other equivalent or similar forms. The port 23 is preferably covered using cover 40. The battery 21 is preferably configured to provide one year of usage per charge based on standard expected usage conditions. To prevent unintentional operation of buttons 24*a*, 24*b* and draining of the battery, the PCB 18 may be configured to timeout after pressing continuously for a predetermined period of time, such as three to six seconds for example.

To allow extended use of the lock 10, a microcontroller in the PCB is preferably not always on and configured to operate at times in a standby mode or in sleep mode to reduce battery use. In ordinary usage, the lock 10 broadcasts at regular intervals, moving to the microcontroller into sleep mode in between unless activated by a user, such as by pressing a button. In standby mode, which is user operated, the communications module is disabled, which may also be desirable during flights. A user may be able to select a predetermined time during which the lock is in standby mode, based on their expected flight time. Operation of standby mode may be based on a timer, location, prompt from the paired mobile device or a predetermined button press combination, such as a long single hold down for example. In other forms, airlines may be provided with electronic communication means that communicate with the lock 10 to trigger a transition to standby mode. It will also be appreciated that the lock 10 is preferably configured to lock on discharge of the battery.

The PCB board 18 may also control LED lights, preferably an RGB LED, within the housing for indicating various states of operation or use of the buttons 24*a*, 24*b*. In one form, individual LEDS may be provided and, for example, a red LED may be provided to indicate a low battery charge, or that the lock is locked or out of range from a paired mobile device, or that an incorrectly entered unlock code has been used. A green LED may be provided to indicate that the lock is unlocked, or in range of a paired mobile device, or that a correctly entered unlock code has been used. In a preferred form, a programmable RGB LED is used so that the different colours can be used to indicated different states or modes of operation.

The embodiments have been described by way of example only and modifications are possible within the scope of the invention disclosed. For example, although the lock is illustrated as a separate component, the lock may be incorporated into a suitcase. Furthermore, although the lock has been described as a lock for luggage, it will be appreciated that it will have many other applications. For example, the lock may be used for locking a diverse range of articles, such as bikes, lockers or mailboxes, or delivery packages for example. In such an example, one party (a retailer for example) may forward a locked package to another party (such as a customer for example) with the unlock code being sent separately to allow only granted users access to the package.

The invention claimed is:

1. A portable electronic lock for luggage, comprising:

a housing;

a securement member in cooperation with the housing to secure an item to the lock;

a locking mechanism in the housing in communication with the securement member to releasably secure the securement member to the housing;

a communications module in the housing for operating the locking mechanism to release and secure the securement member in response to a wireless signal; and a secondary release system for releasing the locking mechanism, wherein the secondary release system is selectively operable, wherein, on insertion of a mechanical key into a lock barrel in the housing, the secondary release system generates an electrical signal for releasing the locking mechanism upon insertion and rotation of the key, and wherein the secondary release system can be disabled via the communications module with a command from a wireless signal or paired mobile device.

2. A lock according to claim 1, further comprising two buttons on the housing, the buttons operable for manually releasing the locking mechanism on performance of a configurable unlocking sequence.

3. A lock according to claim 1, wherein the securement member is a cable, an end of which is secured within the housing on operation of the locking mechanism.

4. A lock according to claim 3, wherein the housing includes an indentation in which an intermediate portion of the cable can be received when in a secured condition.

5. A lock according to claim 1, wherein the locking mechanism includes an electric motor operable to bring a locking pin into engagement with an end of the securement member to secure the end of the securement member within the housing.

6. A lock according to claim 1, wherein the communications module is configured for operation using a Bluetooth protocol.

7. A lock according to claim 1, wherein the locking mechanism is operable when in close proximity with a paired mobile device.

8. A lock according to claim 7, wherein the locking mechanism is operable only when a passcode is entered into the paired mobile device.

9. A lock according to claim 1, wherein the location of the lock can be determined through communication with an unpaired mobile device.

10. A lock according to claim 9, further including an alarm operable when the lock moves outside a predetermined boundary.

11. A lock according to claim 1, further including an indicator for locating the lock.

12. A lock according to claim 11, wherein the indicator provides an audible or visible indication.

13. A lock according to claim 1, wherein the housing has slots formed therein, in which ends of zippers can be received to secure the zippers together within the housing.

14. A lock according to claim 1, wherein the lock can be configured to be operable in response to wireless signals from more than one device.

15. A lock according to claim 1, wherein the secondary release system operates via an electrical contact that is closed on insertion and/or rotation of a mechanical key into the lock barrel.

16. A lock according to claim 1, further including a microcontroller configured to record the history of locking and unlocking activities of the lock.

17. A lock according to claim 16, where a GPS location corresponding to the said locking and unlocking activities is also recorded.

18. A lock according to claim 1, wherein the wireless signal is a signal from the paired mobile device.

19. A lock according to claim 1, wherein access to the lock via a further mobile device may be granted to a third party via the paired mobile device.

20. A lock according to claim 1, wherein communication between the communications module and the paired mobile device is encrypted.

21. A lock according to claim 1, wherein following an unlock command, the lock is configured to automatically relock if the securement member is not removed from the housing within a predetermined time.

22. A portable electronic lock comprising:

a housing;

a securement member in cooperation with the housing to secure an item to the lock;

a locking mechanism in communication with the securement member, the locking mechanism located in the housing, and configured to releasably secure the securement member to the housing;

a communications module located in the housing, the communications module configured to operate the locking mechanism to release or secure the securement member in response to a wireless signal; and a secondary release system located in the housing, the secondary release system selectively operable in a first operational mode and a second operational mode, wherein in the first operational mode, the secondary release system is configured to release the locking mechanism on insertion of a mechanical key into a lock barrel in the housing, the secondary release system generating an electrical signal for releasing the locking mechanism on rotation of the key, and wherein in the second operational mode, the secondary release system does not release the locking mechanism.

* * * * *